United States Patent [19]

Schilp

[11] 4,337,163

[45] Jun. 29, 1982

[54] LIQUID, THICKENED CHLORINE BLEACHING COMPOSITION

[75] Inventor: Ulrich Schilp, Vlaardingen, Netherlands

[73] Assignee: Lever Brothers Company, New York, N.Y.

[21] Appl. No.: 209,189

[22] Filed: Nov. 21, 1980

[30] Foreign Application Priority Data

Dec. 5, 1979 [NL] Netherlands ..... 7908798

[51] Int. Cl.[3] ..... C11D 7/54; C11D 9/30; C11D 9/44

[52] U.S. Cl. ..... 252/96; 252/98; 252/102; 252/97; 252/99; 252/187.24

[58] Field of Search ..... 252/98, 96, 102, 187 H

[56] References Cited

U.S. PATENT DOCUMENTS

| | | | |
|---|---|---|---|
| 3,491,028 | 1/1970 | Crotty et al. | 252/103 |
| 3,684,722 | 8/1972 | Hynam et al. | 252/98 |
| 3,843,548 | 10/1974 | James | 252/187 H |
| 4,113,645 | 9/1978 | DeSimone | 252/98 |
| 4,151,104 | 4/1979 | Alvarex et al. | 252/99 |
| 4,154,694 | 5/1979 | Donaldson | 252/98 |
| 4,229,313 | 10/1980 | Joy | 252/98 |
| 4,271,030 | 6/1981 | Brierley | 252/98 |

FOREIGN PATENT DOCUMENTS

| | | | |
|---|---|---|---|
| 2756414 | 6/1978 | Fed. Rep. of Germany . | |
| 2837880 | 3/1979 | Fed. Rep. of Germany . | |
| 2849225 | 5/1979 | Fed. Rep. of Germany . | |
| 148103 | 8/1970 | Netherlands . | |
| 7400766 | 7/1974 | Netherlands . | |
| 7504507 | 4/1975 | Netherlands . | |
| 7605328 | 3/1976 | Netherlands . | |
| 1329086 | of 0000 | United Kingdom . | |
| 1466560 | 3/1970 | United Kingdom . | |
| 1466560 | 3/1977 | United Kingdom | 252/102 |
| 2003522 | 3/1979 | United Kingdom . | |
| 2015603 | 9/1979 | United Kingdom . | |

*Primary Examiner*—Mayer Weinblatt

*Attorney, Agent, or Firm*—James J. Farrell; Melvin H. Kurtz

[57] ABSTRACT

In liquid, pourable, thickened chlorine bleaching compositions, in which the thickening is produced by at least two different detergent active compounds, a buffer salt is included to improve their stability at lower chlorine levels and at reduced pH values. Typically, a composition comprises an aqueous solution of alkali-metal hypochlorite, thickened by means of a tertiary amine oxide and a saturated fatty acid soap, and contains an alkali-metal orthophosphate buffer system, at a chlorine content of 1–10% and a pH of 10–12.5. The compositions are useful in bleaching operations, especially in bleaching hard surfaces such as toilets, tiles, kitchen sinks, etc.

5 Claims, No Drawings

LIQUID, THICKENED CHLORINE BLEACHING COMPOSITION

The present application relates to a liquid, thickened chlorine bleaching composition, based on an aqueous alkali-metal hypochlorite solution. Thickened chlorine bleaching compositions are already known from British patent No. 1,329,086. Therein thickened chlorine bleaching compositions are described which have an active chlorine content of 1–15% by weight, and which contain a trialkylamine oxide having a straight-chain $C_8$–$C_{18}$ alkyl group or a betaine having a straight-chain $c_8$–$c_{18}$ N-alkyl group, as well as an alkali-metal salt of a fully saturated $C_8$–$C_{18}$ fatty acid. The weight ratio of the trialkylamine oxide or betaine to the alkali-metal soap is in that case from 90:10 to 20:80, and the total amount by weight of the trialkylamine oxide or betaine and the alkali-metal soap is from 0.5–2.5% by weight of the bleaching composition.

Although these liquid, thickened chlorine bleaching compositions have very satisfactory physical properties, both with respect to the chlorine stability and the physical storage stability, particularly with the usual higher contents of active chlorine (10% or higher), it has been found that a reduction of the active chlorine content can in certain circumstances lead to a lesser degree of thickening.

In addition to that, usually a certain amount of alkali hydroxide is incorporated in the thickened chlorine bleaching compositions according to the prior art; the thickened chlorine bleaching compositions thus obtained then usually also have a high pH, in the order of magnitude of 13 or more. A reduction of the pH, to e.g. 12 or lower, can, without special measures, lead to a decreased chlorine stability, as well as also to a decreased storage- or phase stability.

One or more of the above-mentioned problems can also be expected when thickened chlorine bleaching compositions with a reduced content of active chlorine are prepared starting from other detergent active compounds which are soluble in hypochlorite, such as e.g. sarcosinates, taurides, sugar esters and suchlike, as described in Netherlands patent application No. 7605328 (laid open to public inspection), in British patent specification No. 1,466,560 and also in German patent application No. 2,837,880 (laid open to public inspection).

The aim of the present invention is now to eliminate the above-mentioned disadvantages to an important extent and to provide a chlorine bleaching composition that has a reduced content of active chlorine as well as a reduced pH and that nevertheless can be thickened and remains stable for longer periods, without giving rise to an undesired reduction of the cloud point upon variation of the weight ratio of the component ingredients of the detergent active compound mixture used.

It has now been found that this aim can be reached by including in the thickened chlorine bleaching composition a buffer salt of a strong base and a weak inorganic acid. (By this no alkali-metal hypochlorite is to be understood.)

From U.S. Pat. No. 4,151,104 it is already known to include an alkali-metal orthophosphate buffer in an aqueous alkali-metal hypochlorite solution, in order to improve the chlorine stability thereof. The compositions thus obtained are not thickened chlorine bleaching compositions and so the problem of the reduced storage stability of thickened chlorine bleaching compositions with a reduced content of active chlorine does not come up for discussion in the publication.

From U.S. Pat. No. 3,843,548 paste- and gel-like chlorine bleaching compositions are known in which a synthetic clay is used as paste- and gel-forming agent. In these compositions buffer systems can be included in order to check the possible decomposition of the hypochlorite. From German patent application No. 2,756,414 (laid open to public inspection) there is known, inter alia, a thickened, abrasive-containing chlorine bleaching composition in which a smectite clay is included as thickening agent. At the same time certain buffers can be included in order to increase the stability of the alkali-metal hypochlorite. Similar bleaching compositions containing abrasives are also described in Netherlands patent application No. 7504507 (laid open to public inspection). Finally, Netherlands patent application No. 7400766 (laid open to public inspection) describes pourable, liquid washing compositions which, in addition to an abrasive, can contain a bleaching agent, in which a moderately water-soluble alkaline buffer is dispersed as solid particles.

All these prior art bleaching compositions are either not thickened, or they have been thickened with the aid of a clay or contain water-insoluble particles of an abrasive.

However, in the thickened chlorine bleaching composition of the type described in British Pat. No. 1,329,086, such clays or abrasive particles cannot be stably suspended.

Therefore the present invention relates to liquid, thickened chlorine bleaching compositions which are substantially free from water-insoluble, solid abrasive or clay particles, which compositions are based on an aqueous alkali-metal hypochlorite solution which has been thickened by means of a mixture of two different detergent active compounds to a viscosity of abt. 10 to 150 cS ($=10\times10^{-6}m^2\ S^{-1}$–$150\times10^{-6}m^2S^-$) measured with an Ostwalt viscosimeter at a temperature of 25° C.), and is characterized in that the compositions have a content of active chlorine of 1–10% by weight and also contain a buffer salt of a strong base and a weak inorganic acid.

The thickening agent consists of at least two different detergent active compounds of which at least one must be soluble in aqueous hypochlorite solutions. Suitable examples of such washing agents are the trialkylamine oxide according to Netherlands patent No. 148,103 or German patent No. 2,837,880; betaines according to Netherlands patent No. 148,103; and quaternary ammonium compounds according to U.S. Pat. No. 4,113,645 and Netherlands patent application No. 7605328. Mixtures of these washing agents can also be used. The other detergent active compounds present in the thickener can be alkali-metal soaps according to British Pat. No. 1,329,086, alkali-metal acylsarcosinates or -alkyltaurides according to British Pat. No. 1,466,560 or sugar esters according to Netherlands patent application No. 7605328, or mixtures thereof. Alkali-metal $C_{10}$–$C_{18}$ alkylether (containing 1–10 moles of ethylene and/or propylene oxide) sulphates can also be used.

However, the mixtures of trialkylamine oxides and alkali-metal soaps of fully saturated $C_8$–$C_{18}$ fatty acids as described in British Pat. No. 1,329,086 are preferred.

The thickening agent is used in an amount of 0.5–5% by weight based on the final product.

The weight ratio of the hypochlorite-soluble detergent active substance to the other detergent active substance in the thickening agent can vary from 75:25 to 40:60. It has been found that in particular at a weight ratio from 65:35 to 45:55 the invention yields exceedingly satisfactory results. With rising weight ratios it has appeared that with the reduced content of active chlorine according to the invention the thickening becomes less satisfactory. It was found that the addition of a small amount, in the order of magnitude of 0.1–15%, of a strong electrolyte, for example common salt, sodium carbonate, trisodiumorthophosphate, sodium hydroxide, potassium chloride and the like, causes the thickening action to increase.

The content of the active chlorine according to the invention is from 1–10% weight. Preferably this is from 1–7%, and it has been found that the invention is particularly applicable at a content of 1–2.5% by weight. Although alkali-metal hypochlorites are preferred, other chlorine compounds which yield the hypochlorite-ion in alkaline aqueous solution may also be used, e.g. calcium and magnesium hypochlorite, alkali-metal dichloro-isocyanurate, chloramines and the like.

The pH of the thickened chlorine bleaching composition varies between 10 and 12.5. Although many salts of strong bases and weak inorganic acids can be used according to the invention, preferably those salts are used which display a maximum buffering capacity within this pH range. Examples of such salts can be readily found in the general literature on buffers; suitable examples are the alkali-metal salts of orthophosphoric acid, of silicic acid and of carbonic acid. Buffer systems found to be particularly suitable are those consisting of a mixture of trisodium or tripotassium orthophosphate and disodium ordipotassium orthophosphate, or a mixture of sodium or potassium carbonate and sodium or potassium bicarbonate. The ratio of the component ingredients of these mixtures, as well as the amount of these mixtures to be used, is determined, as is known, by the desired pH and the desired buffering capacity, respectively, as well as the viscosity of the composition. For the phosphate buffer, for example, the weight ratio of trisodium orthophosphate to disodium orthophosphate is 70:30 or less, in order to reach a pH of more than 10. The amount of salt to be used varies, as set out above, according to the desired buffering capacity. Thus, with a weight ratio of $Na_3PO_4/Na_2HPO_4$ of 70:30 or less at a concentration thereof of more than 127.2 mmol/kg, a pH of less than 12 is reached. This concentration applies also to the above-indicated $Na_2CO_3/NaHCO_3$ systems in the ratios mentioned. Generally speaking at least 50 mmol of the salt per kilogramme of the bleaching composition is desired; in most instances not more than 350 mmol/kg will be required, and usually the amount will range from 100–250 mmol/kg. The salts of the strong base and weak inorganic acid can be added as such, or they can be formed in situ.

Further, the thickened chlorine bleaching compositions according to the invention can contain small amounts of usual additives such as hypochlorite-soluble and stable colorants and perfumes. Small amounts (up to 5%) of insoluble solid particles are also tolerable.

The compositions of the invention can be prepared in usual ways, for example as described in British patent specification 1,329,086.

The compositions of the invention are useful for all bleaching purposes, especially for bleaching hard surfaces, such as toilets, tiles, floors, kitchen sinks, etc., where by their thickened nature they adhere longer to the surface than non-thickened bleaching compositions.

The invention will be further illustrated by the following examples:

EXAMPLE 1

The following thickened chlorine bleaching compositions A—D were prepared: To 6% by weight of soft water a varying amount of lauric acid was added, as well as 0.05% by weight of sodium hydroxide. This mixture was heated to about 80° C. until the saponification was complete. Subsequently, after cooling to about 40° C., a varying amount of lauryl-dimethylamine oxide (30% aqueous solution) was added, as well as 0.08% by weight of perfume. To the mixture thus obtained 20.7% by weight of an approximately 12.1% aqueous solution of sodium hypochlorite was added, as well as 37.3% by weight of an aqueous solution of 22.7% NaCl, in the case of composition A also containing 0.52% NaOH. Soft water was added to make up 100%. Where indicated, an aqueous phosphate solution containing 166.8 g $Na_3PO_4.12H_2O$ and 43.6 g $Na_2HPO_4.2H_2O$ per kg solution was added in an amount, yielding the indicated amount of phosphates in the products.

In the Table, TW indicates the total amount of lauric acid and amine oxide (in % by weight), and R indicates the ratio: % amine oxide/TW × 100.

The content of active chlorine was 2.5% by weight. The following Table shows the further details.

| Product | R | TW | Electrolyte | Buffer | Viscosity[5] (cS) | Cloud Point[5] (°C.) | pH |
|---|---|---|---|---|---|---|---|
| A | 72 | 0.85 | NaCl/ NaOH[1] | — | 36.4 | 26.8 | 12.7 |
| B | 72 | 0.85 | NaCl[2] | phosphate[4] | 28.6 | 33.4 | 11.9 |
| C | 72 | 0.85 | NaCl[3] | " | 27.4 | 34.6 | 11.9 |
| D | 73.5 | 0.93 | " | " | 27.9 | 41.2 | 11.9 |

Concentrations in % of the total product:
[1]5.65% NaCl and 0.13% NaOH
[2]5.65% NaCl
[3]7.07% NaCl
[4]2.07% $Na_3PO_4 . 12H_2O$ + 0.54% $Na_2PO_4 . 2 H_2O$
[5]after storage for one week at room temperature.

The active chlorine content of product A descreased rapidly, and in products B—D this took place significantly more slowly. Product D was stored for a longer period at room temperature, and the following observations were taken:

| Storage Time (weeks) | Viscosity (cS) | Cloud Point (°C.) | pH | Content of active chlorine (%) |
|---|---|---|---|---|
| 1 | 27.9 | 41.2 | 11.9 | 2.5 |
| 2 | 30.8 | 40.7 | — | — |
| 3 | 30.4 | 42.2 | 11.7 | — |
| 4 | 33.3 | 42.0 | 11.7 | — |
| 5 | 29.8 | 41.8 | — | 2.13 |
| 6 | 28.5 | 41.4 | 11.2 | 2.07 |
| 7 | 29.7 | 39.4 | 11.1 | 1.97 |
| 8 | 30.8 | 38.1 | 11.1 | 1.84 |
| 9 | 31.1 | 37.2 | 10.8 | 1.99 |
| 10 | 31.6 | 35.2 | 11.0 | 1.79 |
| 11 | 27.9 | 33.6 | 11.1 | 1.72 |

(— = not measured)

EXAMPLE 2

The following thickened chlorine bleaching compositions were preared in the same manner as in Example 1:

| | E | F | G | H |
|---|---|---|---|---|
| lauryldimethylamine oxide | 0.683 | 0.683 | 0.683 | 0.683 |
| lauric acid | 0.246 | 0.246 | 0.246 | 0.246 |
| NaOH | 0.153 | 0.153 | 0.153 | 0.153 |
| NaClO | 2.49 | 2.49 | 2.49 | 2.49 |
| perfume | 0.06 | 0.06 | 0.06 | 0.06 |
| $Na_3PO_4 . 12H_2O$ | 6.78 | 2.07 | — | — |
| $Na_2HPO_4 . 2H_2O$ | 1.36 | 0.54 | — | — |
| $Na_2CO_3$ | — | — | 1.22 | 0.77 |
| $NaHCO_3$ | — | — | 0.11 | 0.11 |
| water | to 100 | to 100 | to 100 | to 100 |
| pH after preparation | 12.06 | 12.10 | 12.05 | 12.05 |

Product F was examined further, and the following observations were taken, at different contents of NaCl, after storage for 4 weeks at room temperature (t) and at 30° C. (T).

| | 6.25% NaCl | | 5% NaCl | | 3.75% NaCl | | 0% NaCl | |
|---|---|---|---|---|---|---|---|---|
| | (t) | (T) | (t) | (T) | (t) | (T) | (t) | (T) |
| content of active chlorine | 1.7 | 1.2 | 1.8 | 1.3 | 1.8 | 1.4 | 2.1 | 1.9 |
| pH | 11.5 | 11.1 | 11.5 | 11.1 | 11.6 | 11.2 | 11.9 | 11.7 |
| viscosity | 23.5 | 23.9 | 16.3 | 15.4 | 11.0 | 9.6 | * | |
| cloud point | 54.2 | 40.2 | 85.0 | 72.4 | >90 | >90 | * | |

*with 0% NaCl, after storage for 1 week at room temperature, a viscosity of 4.0 cS and a cloud point of >90° C. were measured.

EXAMPLE 3

The following thickened chlorine bleaching composition was prepared:

| | % |
|---|---|
| lauryldimethylamine oxide (100%) | 0.72 |
| lauric acid (92%) | 0.48 |
| sodium silicate | 0.115 |
| perfume | 0.06 |
| sodium hypochlorite (100%) | 2.5 |
| $Na_3PO_4$ 12 aq | 5.42 |
| $Na_2HPO_4 . 2$ aq | 1.09 |
| NaOH | 0.1 |
| water | to 100 |

This product had a pH of 11.7, a viscosity of 30 cS, and a cloud point of >90° C.

EXAMPLE 4

In the manner as described in Example 1, various thickened chlorine bleaching compositions were prepared, containing the following ingredients:

lauryldimethyl amine oxide
potassium laurate
sodium hypochlorite
tripotassium-/dipotassiumorthophosphate buffer
perfume
KOH
water.

The total amount of lauryldimethyl amine oxide and potassium laurate (TL) was varied, as was the ratio (R) of the tertiary amine oxide $$\left(R = \frac{\%\ \text{amine oxide}}{TL} \times 100\right).$$

The amount of sodium hypochlorite was also varied, as was the amount of buffer. The amount of perfume was in all cases 0.06% by weight, and the amount of KOH was the excess of the amount (25% thereof) used to saponify the lauric acid. These products were stored at room temperature.

The following Table represents further details and data obtained.

| Details | K | | L | | M | | N | |
|---|---|---|---|---|---|---|---|---|
| TL | 1.2 | | 1.2 | | 1.0 | | 1.0 | |
| R | 45 | | 40 | | 75 | | 75 | |
| Amount of buffer (mmol) | 200 | | 200 | | 100 | | 100 | |
| Amount of hypochlorite (% by weight) | 2.5 | | 2.5 | | 5 | | 7 | |
| | initial | after 4 weeks | initial | after 4 weeks | after 1 week | after 2 weeks | initial | after 4 weeks |
| pH | 12.2 | 12.0 | 12.1 | 11.8 | 12.3 | 12.1 | 12.2 | 12.0 |
| viscosity (cS) | 18.5 | 22.7 | 11.4 | 13.6 | 9.3 | 9.0 | 18.6 | 22.6 |
| cloud point (°C.) | >90 | >90 | >90 | >90 | >90 | >90 | 60 | 60 |
| % average chlorine | 2.37 | 2.12 | 2.41 | 2.11 | 4.64 | 4.53 | 6.73 | 5.67 |

EXAMPLE 5

Repeating composition N with KOCl instead of NaOCl produced the following results

| | initial | after 3 weeks |
|---|---|---|
| pH | 12.3 | 12.0 |
| viscosity | 38.1 | 23.9 |
| cloud point | 45 | 42 |
| % average chlorine | 6.75 | 5.52 |

EXAMPLE 6

A formulation, analogous to Example 4, but with sodiumcarbonate as buffer, gave the following results:

| | |
|---|---|
| TL | 1.2 |
| R | 55 |
| Amount of buffer (mmol) | 200 |
| Amount of sodium hypochlorite | 2.5 |

| | initial | after 4 weeks |
|---|---|---|
| pH | 12.2 | 11.7 |
| viscosity | 30.5 | 33.9 |
| cloud point | >90 | >90 |
| % average chlorine | 2.39 | 2.05 |

EXAMPLE 7

Repeating Example 6, but now using 200 mmol sodiumtripolyphosphate as buffer, produced the following results

| | initial | after 3 weeks |
|---|---|---|
| pH | 2.4 | 12.3 |
| viscosity | 66.7 | 91.1 |
| cloud point | >90 | >90 |
| % average chlorine | 2.30 | 2.13 |

I claim:

1. Liquid, thickened chlorine bleaching composition having a pH of 10–12.5 and a viscosity of about 10 to 150 cS at a temperature of 25° C., comprising an aqueous, hypochlorite-ion yielding solution in an amount such that the composition has an active chlorine content of 1–10% by weight, said composition containing as thickening agent 0.5–5% by weight of a mixture of (1) a hypochlorite-soluble first detergent active compound selected from the group consisting of a tertiary amine oxide having one branched or straight $C_{8-18}$ alkyl chain and two short chain alkyl groups, $C_{8-18}$ alkyl-substituted betaines, quaternary ammonium compounds and mixtures thereof, and (2) a second detergent active compound selected from the group consisting of an alkali metal salt of a fully saturated $C_{8-18}$ fatty acid, an alkali metal acylsarcosinate, an alkali metal alkyltauride, a sugar ester, an alkali metal $C_{10-18}$ alkylether sulphate containing 1–10 moles of ethylene oxide and/or propylene oxide and mixtures thereof, the weight ratio of the hypochlorite-soluble first detergent active compound to the second detergent active compound being from 75:25 to 40:60, the composition further comprising from 50–350 m mol/kg of a buffer salt selected from the group consisting of alkali metal salts of orthophosphoric acids, alkali metal salts of silicic acids, alkali metal salts of carbonic acids and mixtures thereof.

2. Composition according to claim 1, said composition having a content of active chlorine of 1–2.5% by weight.

3. Composition according to claims 1, in which the salt is a mixture of trialkalimetal orthophosphate and dialkalimetal orthophosphate.

4. Composition according to claims 2, 3 or 1, said composition having a pH of 10–12.5.

5. A composition according to claims 2, 3, 4 or 1, said composition containing an additional amount of 0.1–15% by weight of a strong electrolyte selected from the group consisting of sodium chloride, sodium carbonate, trisodium orthophosphate, sodium hydroxide and potassium chloride.

* * * * *